US006613191B2

(12) United States Patent
Rienecker et al.

(10) Patent No.: US 6,613,191 B2
(45) Date of Patent: Sep. 2, 2003

(54) PRESSURIZED SCREEN AND PROCESS FOR REMOVING CONTAMINANTS FROM A FIBROUS PAPER SUSPENSION CONTAINING CONTAMINANTS

(75) Inventors: Reimund Rienecker, Heidenheim (DE); Peter Schweiss, Elchingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/000,303

(22) Filed: Dec. 4, 2001

(65) Prior Publication Data

US 2002/0069985 A1 Jun. 13, 2002

(30) Foreign Application Priority Data

Dec. 7, 2000 (DE) ..... 100 60 822

(51) Int. Cl.[7] ..... D21D 5/06; D21D 5/22

(52) U.S. Cl. ..... 162/55; 209/17; 209/279; 209/303

(58) Field of Search ..... 162/17–19, 29, 162/37, 41–43, 52, 55, 57, 237, 238, 239, 241, 242, 245, 246, 248, 249, 251; 99/503, 508, 513; 210/201, 204, 213, 216, 217, 413, 415, 485, 498, 499, 497.01, 435, 439, 497.3; 209/273, 397, 13, 17, 270, 271, 279, 289, 290, 303, 304; 29/896.62

(56) References Cited

U.S. PATENT DOCUMENTS

| | | | | |
|---|---|---|---|---|
| 1,046,108 A | * 12/1912 | Powers | | 210/391 |
| 3,785,495 A | * 1/1974 | Holz | | 210/210 |
| 4,462,901 A | 7/1984 | Gauld | | 209/234 |
| 4,749,475 A | * 6/1988 | Hooper | | 209/273 |
| 5,061,370 A | * 10/1991 | Ferland et al. | | 210/194 |
| 5,575,395 A | * 11/1996 | Alajaaski et al. | | 209/17 |

FOREIGN PATENT DOCUMENTS

| | | | |
|---|---|---|---|
| DE | 2140904 | 3/1973 | |
| DE | 19702044 | 1/1997 | |
| EP | 0 438 092 A1 * | 7/1991 | D21D/5/20 |
| EP | 955406 A3 | 11/1999 | |
| EP | 955406 A2 | 11/1999 | |
| EP | 955408 | 11/1999 | |
| WO | 94/16141 | 7/1994 | |
| WO | 00/52260 | 9/2000 | |
| WO | 00/58549 | 10/2000 | |
| WO | WO 00/58549 * | 10/2000 | D21D/5/02 |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Pressurized screen to remove contaminants from a contaminant-containing fibrous paper suspension. Pressurized screen includes a housing, a first screen element, essentially axially symmetric and rotatably mounted within housing, and a second screen element, which is essentially axially symmetric. First and second screen elements are successively arranged in suspension flow direction. At least one intake, coupled to housing, supplies suspension to housing, and at least one accepts outlet, coupled to housing, conveys a part of suspension that passes through the second screen element out of housing. At least one coarse reject outlet is located within housing to remove a part of suspension not passing through first screen element, and at least one fine reject outlet is located within housing to remove a part of suspension not passing through second screen element. First screen element includes conical shape with opening angle (α) between about 10° and 170°.

46 Claims, 3 Drawing Sheets

PRESSURIZED SCREEN AND PROCESS FOR REMOVING CONTAMINANTS FROM A FIBROUS PAPER SUSPENSION CONTAINING CONTAMINANTS

CROSS-REFERENCE TO RELATED APPLICATIONS

The present application claims priority under 35 U.S.C. §119 of German Patent Application No. 100 60 822.1, filed on Dec. 7, 2000, the disclosure of which is expressly incorporated by reference herein in its entirety.

BACKGROUND OF THE INVENTION

1. Field of the Invention

The invention relates to a pressurized screen to remove contaminants from a contaminant-containing fibrous paper suspension with a vertical housing that contains at least two mainly axially symmetrical screen elements that are arranged so that the fibrous suspension fed through at least one intake into the housing can flow through them in succession. The upstream first screen element can be rotated and is mounted axially outside and above the chamber in which the second screen element is located. A part of the fibrous paper suspension that has passed through the second screen element is channeled out of the housing through at least one accepts outlet. The housing further includes at least one coarse reject outlet for the overflow of the first screen element and at least one fine reject outlet for the overflow of the second screen element.

The invention also relates to a pressurized screen to remove contaminants from a contaminant-containing fibrous paper suspension with a horizontal housing that contains at least two mainly axially symmetrical screen elements that are arranged so that the fibrous suspension channeled into the housing through at least one intake can flow through them in succession. The upstream first screen element can be rotated, and the part of the fibrous paper suspension that has passed the second screen element is channeled out of the housing through at least one accepts outlet. The housing features at least one coarse reject outlet for the overflow of the first screen element and at least one fine reject outlet for the overflow of the second screen element.

2. Discussion of Background Information

Pressurized screens are used in the processing of fibrous paper suspensions, in order to treat the fibrous suspension in a wet screening. To this end such a pressurized screen contains at least one screen element that is provided with a number of openings. The fibers contained in the suspension should pass through the openings, while the unwanted solid particles are rejected there and conveyed out of the screen again. As a rule, round holes or slits are used as screen openings. In most cases, pressurized screens of the kind considered here are equipped with screen scrapers that feature scraping areas swept across the screen. This is how the clogging of the screen openings is usually prevented in the per se known way.

As both the state of disintegration of the paper fiber material and the volume and structure of the contaminant content change constantly in the course of the pulp processing, it is necessary in many cases to operate pressurized screens in several stages with different openings. In this way it is possible to achieve overall a good straining of most of the contaminants collected. Such contaminants, which differ significantly from the other contaminants due to their sinking action, can thereby also be strained by means of hydro-cyclones. This technique is also known, so that a sequence of hydro-cyclones and pressurized screens is used for pulp screening in general.

A vertical separator for a fibrous suspension that features two screen elements in a single machine is known from DE 197 02 044 C1. With this separator, the pulp stream to be sorted first arrives at the area of a flat coarse screen that is kept clear on the intake side with a scraper. The flow through this flat coarse screen is then conducted into the interior of an axially symmetrical screen basket, through the openings of which the accepts pass, so that the suspended paper fibers can pass through this screen basket into the accepts outlet. This kind of screen should be used in particular whenever the supplied fibrous suspension is mixed with a larger amount of coarse contaminants. This is known to occur very often in waste paper processing, especially with the pulp that comes directly from the pulper or after passing through a cleaning device that removes only the coarsest impurities. However, in certain cases this known screen has the disadvantage that a high degree of wear occurs, particularly in the area of the flat primary screen, and the coarse impurities can lead to breakdowns.

WO 00/5 8549 A1 shows a screen with a vertical housing in which there are two screen elements through which the fibrous paper suspension to be cleaned flows successively. In this the two screen elements are at least partially axially fitted into one another, which facilitates a compact construction. Other versions with two screens flowed through successively are known from EP 0 955 406 A2 and DE 2140 904. The first screen is cylindrical and is set in rotation. However, these devices are unfavorable in many applications. This applies in particular to the processing of coarse pulps. A cylindrical screen has the disadvantage in particular that the oblong impurities with a tendency to spin or wind can easily stick to such a screen and then become firmly fastened as a result of the rotation. They can then only be removed manually after shutting down.

A flat, disk-shaped screen, such as is known from WO 00/52260, for instance, has a simple structure and takes up little space. However, it has only a small screen surface, which is disadvantageous.

SUMMARY OF THE INVENTION

The present invention provides a pressurized screen that is unsusceptible to clogging impurities and at the same time offers good screening quality. It may be particularly useable for disintegrated waste paper that still contains a large proportion of the originally contained, hardly crushed contaminants.

According to the instant invention, the first screen element has a conical form with an opening angle ($\alpha$) that is between about 10 and 170°. Moreover, in the horizontal orientation, the first screen element is positioned axially outside of and to the side of the chamber in which the second screen element is located.

A pressurized screen of the type of construction according to the invention is particularly suitable for use at the start of paper stock preparation, that is, wherever a relatively large proportion of coarser contaminants is still carried along in the suspension. If waste paper is brought into the pulper or cleaning drum in suspension, for instance, it often has a contaminant content of more than 2% of the solids. Part of this contaminant is relatively coarse and is therefore also rejected to a great extent at a 4 mm perforation.

After entering the pressurized screen according to the invention, the suspension encounters the intake side of the first screen element. Its rotation creates a centrifugal force with which the contaminants are spun from the surface of this screen element, provided they have a higher specific gravity than the suspension surrounding them. Thus not only the tractive forces created due to the pressure difference, but also centrifugal forces act on the solid particles located near the screen intake. The more the longitudinal direction of the screen opening is oriented radially (instead of axially), the stronger the free centrifugal effect and the lower the danger of the particles being caught in the openings. Heavy particles that are rejected at the screen element according to the specification, leave its intake area relatively quickly and are then removed from the housing through the coarse reject outlet. They may possibly also carry with them light contaminants rejected because of their size, particularly plastic foils. The screen is not only less at risk of wear, but it is also not so easily clogged by wire pieces, splinters of glass and small stones.

The centrifugal effect naturally depends on the speeds and the radius at the place in question. The particular advantage of the invention lies in the fact that the first screen element is constructed conically at least in part. A conical form combines the advantages of a large screen surface with sufficient centrifugal effect from the screen area.

Through the combination according to the invention of the two screen elements that work differently in one housing, a compact machine is created that works reliably even with heavily contaminated liquids. Another advantage is the possibility of being able to provide the first screen element and the scrapers for the second screen element with a common drive.

The pressurized screen according to the invention is easily equipped with an effective light contaminant discharge. Thus Styrofoam and foil pieces can already be concentrated and removed with the aid of centrifugal forces before they have passed the first screen element. The same applies to air. This collection and discharge of light particles is helped by a flat or conical first screen element.

The present invention is directed to a pressurized screen to remove contaminants from a contaminant-containing fibrous paper suspension. The pressurized screen includes a housing, a first screen element, which is essentially axially symmetric and is rotatably mounted within the housing, and a second screen element, which is essentially axially symmetric. The first and the second screen elements are successively arranged in a suspension flow direction. At least one intake, coupled to the housing, is structured and arranged to supply the suspension to the housing, and at least one accepts outlet, coupled to the housing, is structured and arranged to convey a part of the suspension that passes through the second screen element out of the housing. At least one coarse reject outlet is located within the housing to remove a part of the suspension not passing through the first screen element, and at least one fine reject outlet is located within the housing to remove a part of the suspension not passing through the second screen element. The first screen element includes a conical shape with an opening angle ($\alpha$) between about 10° and 170°.

In accordance with a feature of the instant invention, the housing can be a vertical housing, and axes of the first and the second screen elements may be vertically arranged. Further, the first and the second screen elements may be coaxially arranged. The first screen can be positioned above the second screen element, and the suspension flow direction can be from an upper part of the housing to a lower part of the housing. Moreover, the first screen may be positioned axially outside of and above the second screen element, and the suspension flow direction can be from an upper part of the housing to a lower part of the housing.

According to another feature of the invention, the housing can include a vertical housing having an upper chamber and a lower chamber, such that the first screen element is positioned within the upper chamber and the second screen element is positioned within the lower chamber.

Further, the housing may be a horizontal housing, and axes of the first and the second screen elements can be horizontally arranged. The first and the second screen elements may be coaxially arranged. The first screen can be positioned upstream of the second screen element, relative to the suspension flow direction. The first screen may be positioned axially outside of the second screen element.

The housing can include a horizontal housing having an first chamber positioned upstream from a second chamber, relative to the suspension flow direction, such that the first screen element is positioned within the first chamber and the second screen element is positioned within the second chamber.

In accordance with still another feature according to the instant invention, the opening angle ($\alpha$) can be between about 60° and 120°.

According to a further feature of the present invention, the second screen element can be fixed in the housing.

A centrally aligned light reject outlet may be coupled to the housing. The light reject outlet can be located in a region of the first screen element. The first screen element may be arranged in the housing to form an intake chamber outside of the first screen element, and the light reject outlet may be located in the intake chamber. Further, the light reject outlet can include a closable valve that automatically opens for a short time at intervals. A rotor can be arranged to drive the first screen element, such that no mounting structure is positioned between the first screen element and the light reject outlet.

The first screen element may include a double conical form in which a diameter of the double conical form increases in the suspension flow direction.

A diameter of the conical shape may increase in the suspension flow direction.

Moreover, a diameter of the conical shape of the first screen element can increase in a direction toward the second screen element.

Fixed screen scrapers can be located on a throughput side of the first screen element.

According to another feature of the present invention, fixed scrapers may be located on an inlet side of the first screen element.

In accordance with still another feature of the instant invention, an inlet side of the first screen element can have a profiled surface.

In accordance with a further feature of the invention, an inlet side of the first screen element can be equipped with bars.

The first screen element can include round holes having a diameter of at least about 2 mm. Preferably, the round holes can have a diameter of at least about 4 mm. Further, at least some of the round holes may have a diameter of at least about 4 mm.

The first screen element may include screen openings having different sizes in accordance with a radial position on the first screen element. The screen openings can increase in size as the radial position of the screen opening is farther out.

At least one flow guide element can be located in an intake chamber adjacent the first screen element. The at least one flow guide element can be arranged to influence peripheral movement of the suspension in the intake chamber. Further, at least one flow guide element can include arched surfaces arranged to divert a peripheral flow in the intake chamber radially toward a middle.

In accordance with the invention, the second screen element may include a cylindrical screen basket.

Further, the second screen element can include round screen openings having a diameter of no more than about 2 mm.

A rotor can be provided and scrapers can be coupled to the rotor. In this manner, the scrapers can be arranged for movement to keep the second screen element clear. The rotor may be coupled to rotatably drive the first screen element. Moreover, the rotor may move the scrapers at speed different than a rotational speed of the first screen element.

In accordance with a further feature, a first and a second rotor can be provided. The first rotor can be coupled to the first screen element to rotatably drive the first screen element, and the second rotor can be coupled to the scrapers to move the scrapers. The rotors may be coaxially arranged.

According to still another feature of the instant invention, the at least one intake can open tangentially into the housing.

In accordance with yet still another feature according to the present invention, a largest inside diameter of the first screen element can be larger than a largest inside diameter of the second screen element.

The present invention is directed to a process for removing contaminants from a contaminant-containing fibrous paper suspension. The process includes supplying the suspension containing contaminants into a pressurized screen, separating a coarse fraction of contaminants with a first rotating conical screen element, in which the conical screen has an opening angle of between about 10° and 170°, separating a fine fraction of contaminants with a second screen element, and conveying the suspension without the coarse and fine contaminants out the pressurized screen.

In accordance with a feature of the invention, the coarse fraction separation can occur upstream of the fine fraction separation, relative to a suspension flow direction. Further, the coarse fraction separation may occur vertically above the fine fraction separation. Alternatively, the coarse fraction separation may occur horizontally adjacent the fine fraction separation.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is directed to a "pressurized screen," which is so named because these devices are closed and because the throughput occurs from a pressure difference between an intake and a pass through (accepted stock). Moreover, there are other screen devices that are open at the top, in which case, they cannot be referred to as pressurized screens. The level of pressure in the housing of a pressurized screen depends on the pressure difference necessary to convey the suspension through the screen with a desired quantity per unit of time. A second aspect, which is also very important in many cases, is that the flow of accepted stock leaving the pressurized screen housing has to be under a certain excess pressure, so that it can be transported the appropriate distance through pipelines.

Figure 1:
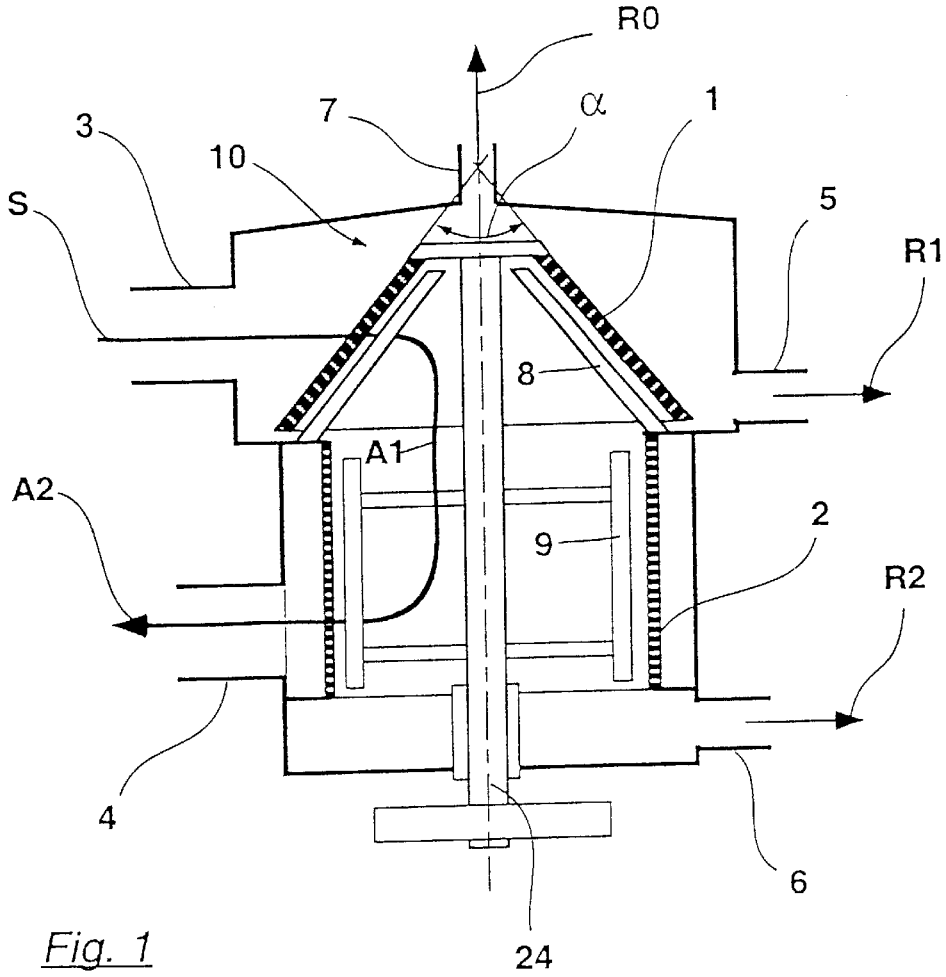
FIG. 1 illustrates the functional structure of a pressurized screen according to the features of the instant invention.

FIG. 1 shows, even if only in diagrammatic form, the most important functional parts that are part of the pressurized screen according to the invention. In the housing, when this apparatus is in operation, the fibrous paper suspension S is fed through the inlet 3 and arrives first in the intake chamber 10, where a conical first screen element 1 is located. Its opening angle $\alpha$ is adapted to the requirements and as a rule is between about 60° and 120°. In accordance with an exemplary embodiment of the present invention, first screen element 1 can be set in rotation, e.g., via a rotor 24. To prevent clogging of the screen openings in first screen element 1, fixed screen scrapers 8 are located on an accepts side of screen element 1, i.e., on the discharge side, to create pressure impulses. The effect of screen scrapers 8 is known and, therefore, no further explanation of this feature is believed necessary. The configuration on the accepts side leads to a substantial reduction of wear and prevents materials rejected at screen element 1 from getting caught. Contaminants that are rejected by screen element 1 because of their size or shape, i.e., that cannot pass through it, flow together with a small portion of the suspension as overflow R1 through a coarse reject outlet 5 out of the housing. Coarse reject outlet 5 also passes contaminants that have not gone through screen element 1 because of the centrifugal effect described below with reference to FIG. 2.

The housing of the pressurized screen is constructed so that a path A1 of the suspension passing through first screen element 1 can go directly to an intake side of second screen element 2. Path A2 of the suspension passing second screen element 2 is discharged through accepts outlet 4 and rejected overflow R2, which does not pass through second screen element 2, is conveyed through fine reject outlet 6. To keep second screen element 2 clear, moving scrapers 9 are provided, which can be connected to rotor 24. In this manner, first screen element 1 and moving scrapers 9 can be powered with a same rotational speed. However, it is also conceivable that the operator may desire to drive first screen element 1 and moving scrapers 9 at different rotational speeds. In this event, first screen element 1 can be to be powered, e.g., by a further shaft (see, e.g., 24' in FIG. 3) that can be arranged to run coaxially, such as inside a rotor 26.

The choice of a cylindrical screen, also called a screen basket, as a second screen element 2 can be especially advantageous. Such screen baskets offer a large screen surface as well as high stability and easy clearing ability. With the pressurized screen according to the invention, no more difficulties due to coarse contaminants are anticipated at this stage. A small screen perforation can therefore be selected.

Figure 2:
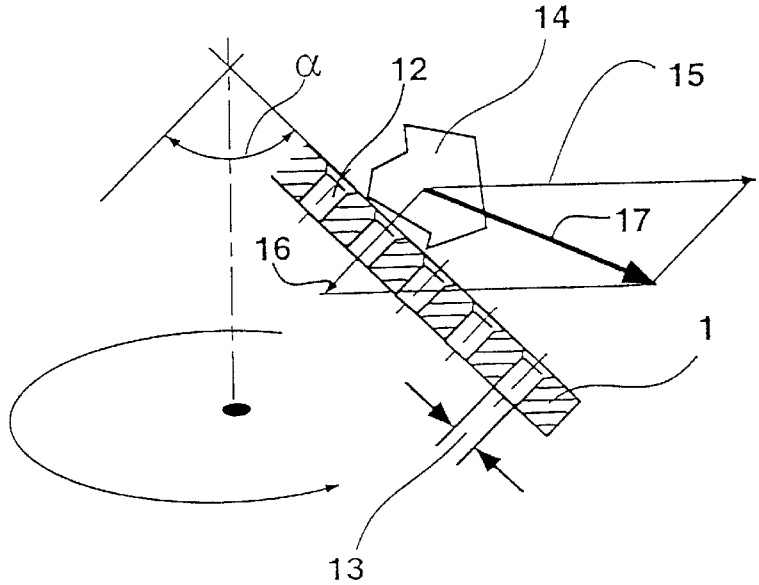
FIG. 2 schematically illustrates the force conditions at the conical screen element.

In FIG. 2, the forces arising in intake chamber 10 are schematically represented in qualitative terms as acting on a solid particle 14 located near screen opening 12. Centrifugal force 15 acts in a radially outward direction, and tractive force 16 acts in the direction of screen opening 12. With heavy particles, centrifugal force 15 is great enough to create a resultant force 17 that removes solid particle 14 from screen element 1. A smallest diameter 13 of screen opening 12 is important for the screening effect. With typical applications in accordance with the features of the instant invention, this smallest diameter 13 is, e.g., at least about 2 mm, and preferably about 4 mm, because at this stage, the material is relatively coarse. A phase in an intake area of screen openings 12 can improve the clogging properties of first rotating screen element 1. Under certain circumstances it may be reasonable to make screen openings 12 of different sizes. In this regard, it is note that, due to the shape of first screen element 1, depending on the radial distance from the middle, varying screen conditions (e.g., influx angle at the intake in the screen opening and centrifugal forces) are possible, which is often undesirable. However, these disadvantages can be compensated for according to the instant invention.

Figure 3:
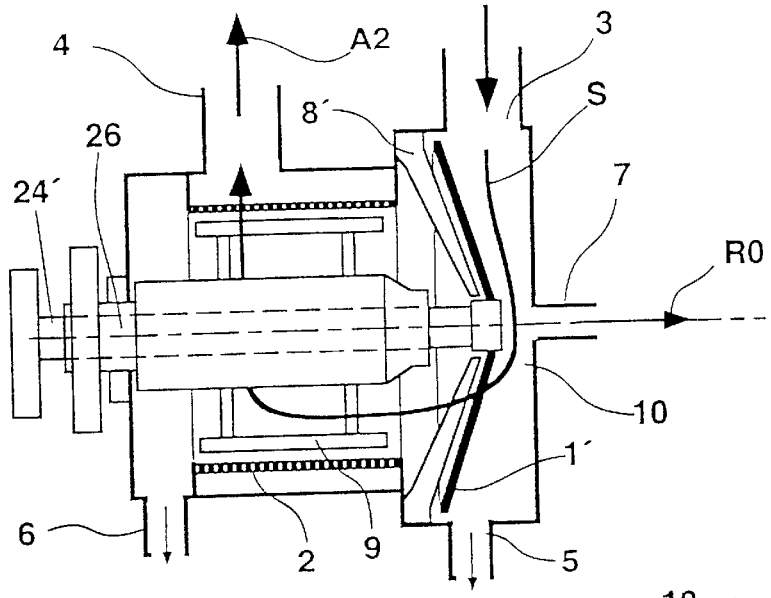
FIGS. 3, 4, 5, and 6 illustrate various exemplary embodiments of the pressurized screen in accordance with the features of the present invention.

FIG. 3 illustrates an alternative arrangement for the exemplary embodiment in which the pressurized screen can be horizontally arranged with a horizontal screen having a horizontal axis. This arrangement can offers advantages in terms of space and can improve the discharge of heavy particles through coarse reject outlet 5 through the aid of gravity.

Figure 4:
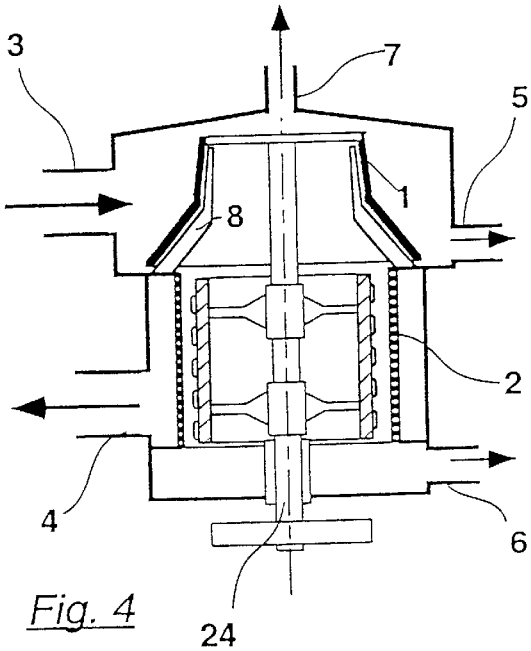
Figure 5:
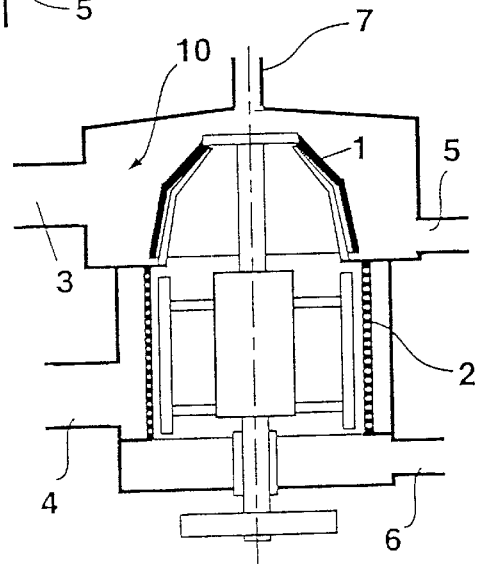

As already stated, the shape of first screen element 1, and particularly opening angle $\alpha$, plays an important role in establishing the qualities of the pressurized screen. Moreover, as illustrated in FIGS. 4 and 5, first screen element 1' can formed by a plurality of segments in which each segment is conical, albeit with a different opening angle $\alpha$.

Moreover, with regard to second screen element 2, a number of per se known design possibilities are available, and the cylindrical form is probably optimal. Further, blades, foils (see, e.g., FIGS. 1, 3 and 5) or drum rotors (see, e.g., FIGS. 4 and 7) equipped with overhangs can be used as scrapers to keep second screen element 2 clear. Moreover, second screen element 23 can include openings, e.g., round openings, with a diameter of, e.g., no more than 2 mm.

Figure 6:
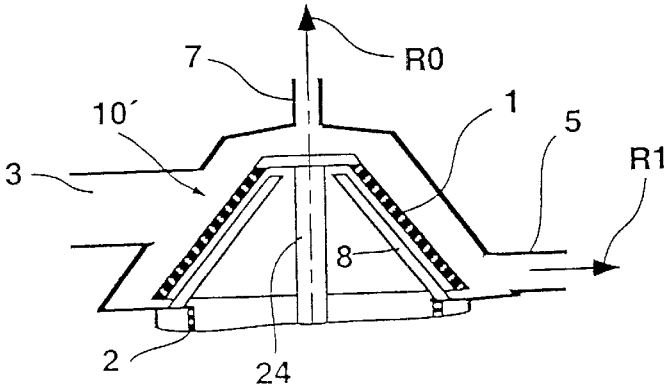

It can also be advantageous to adjust a contour of intake chamber 10 to correspond to the contour of first screen element 1, e.g., as illustrated in FIG. 6. In this example, a conical upper section of the housing corresponding to the conical form of first screen element 1 can be provided.

Figure 7:
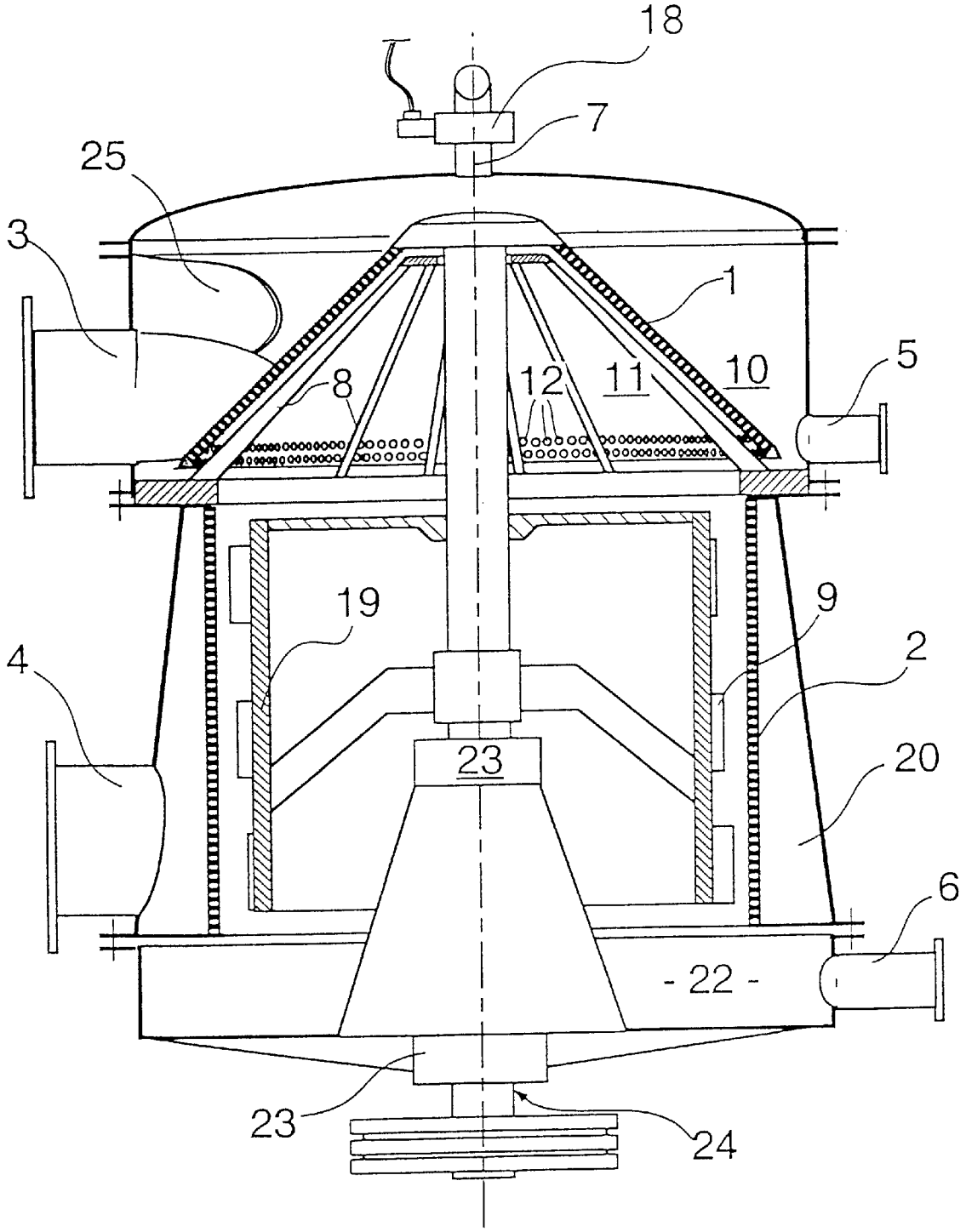
FIG. 7 illustrates greater detail of a sectional side view of the pressurized screen depicted in FIG. 1.

FIG. 7 illustrates a somewhat more detailed arrangement of the pressurized screen depicted in FIG. 1. However, it is noted that this illustration is intended to for the purpose of explanation and should not be construed as in any way limiting. First screen element 1, which has a conical form, is positioned within an upper section of the housing to form an intake chamber 10 connected to intake 3 for the suspension. For the purpose of clarity, only part of the screen openings 12 of first screen element 1 is shown. A number of fixed screen scrapers 8 are centrally located inside first screen element 1, which can be connected to the housing on their undersides. The two screen elements 1 and 2 are positioned so that first screen element 1 divides the upper section of the housing into intake chamber 10 and a first accepts chamber 11, which is located centrally within first screen element 1 and is connected with the intake chamber to second screen element 2. Further, second screen element 2 divides a lower part of the housing into the intake chamber to screen element 2 and accepts chamber 20, which is connected with the accepts outlet 4. The intake chamber of second screen element 2 merges at its lower end into reject chamber 22, which, in turn, is connected with fine reject outlet 6. Second screen element 2 can be kept free of clogging by the fact that a drum 19 with scrapers 9 mounted thereon is located on rotor 24, which can also used to drive element 1. Appropriately, rotor 24 is overhung, i.e., a strong mounting 23 including several parts holds the rotor from underneath. In this manner, the upper section of the rotor can remain free of a mounting so that spinning impurities located in the upper section of the screen do not catch, but can slide off centrally. In the upper section of the housing, a light reject outlet 7 can be position, which can be intermittently opened and closed by a valve 18.

In intake chamber to 10, a flow control element 25 is schematically indicated. Such control elements can be used to keep the suspension flowing through intake 3 in rotation and/or to guide it radially in an inward direction toward first screen element 1. As first screen element 1 rotates in the operation of the pressurized screen, it is necessary to set the suspension in rotation, too, so that it can flow through the screen openings 12 of the screen element. Further, intake 3 may be tangentially connected to the housing.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pressurized screen to remove contaminants from a contaminant-containing fibrous paper suspension, comprising:

a housing;

a first screen element, which is essentially axially symmetric, being rotatably mounted within said housing;

a second screen element, which is essentially axially symmetric;

said first and said second screen elements being successively arranged in a suspension flow direction;

at least one intake, coupled to said housing, which is structured and arranged to supply the suspension to said housing;

at least one accepts outlet, coupled to said housing, being structured and arranged to convey a part of the suspension that passes through said second screen element out of said housing;

at least one coarse reject outlet located within said housing to remove a part of the suspension not passing through said first screen element;

at least one fine reject outlet located within said housing to remove a part of the suspension not passing through said second screen element; and said first screen element comprising a conical shape with an opening angle ($\alpha$) between about 10° and 170°.

2. The pressurized screen in accordance with claim 1, wherein said housing is a vertical housing, and axes of said first and said second screen elements are vertically arranged.

3. The pressurized screen in accordance with claim 2, wherein said first and said second screen elements are coaxially arranged.

4. The pressurized screen in accordance with claim 3, wherein said first screen is positioned above said second screen element, and said suspension flow direction is from an upper part of the housing to a lower part of the housing.

5. The pressurized screen in accordance with claim 3, wherein said first screen is positioned axially outside of and above said second screen element, and said suspension flow direction is from an upper part of the housing to a lower part of the housing.

6. The pressurized screen in accordance with claim 1, wherein said housing comprises a vertical housing having an upper chamber and a lower chamber, such that said first screen element is positioned within said upper chamber and said second screen element is positioned within said lower chamber.

7. The pressurized screen in accordance with claim 1, wherein said housing is a horizontal housing, and axes of said first and said second screen elements are horizontally arranged.

8. The pressurized screen in accordance with claim 7, wherein said first and said second screen elements are coaxially arranged.

9. The pressurized screen in accordance with claim 8, wherein said first screen is positioned upstream of said second screen element, relative to said suspension flow direction.

10. The pressurized screen in accordance with claim 9, wherein said first screen is positioned axially outside of said second screen element.

11. The pressurized screen in accordance with claim 1, wherein said housing comprises a horizontal housing having an first chamber positioned upstream from a second chamber, relative to said suspension flow direction, such that said first screen element is positioned within said first chamber and said second screen element is positioned within said second chamber.

12. The pressurized screen in accordance with claim 1, wherein said opening angle ($\alpha$) is between about 60° and 120°.

13. The pressurized screen in accordance with claim 1, wherein said second screen element is fixed in said housing.

14. The pressurized screen in accordance with claim 1, further comprising a centrally aligned light reject outlet coupled to said housing.

15. The pressurized screen in accordance with claim 14, wherein said light reject outlet is located in a region of said first screen element.

16. The pressurized screen in accordance with claim 14, wherein said first screen element is arranged in said housing to form an intake chamber outside of said first screen element, and said light reject outlet is located in said intake chamber.

17. The pressurized screen in accordance with claim 16, wherein said light reject outlet includes a closable valve that automatically opens for a short time at intervals.

18. The pressurized screen in accordance with claim 17, further comprising a rotor arranged to drive said first screen element, wherein no mounting structure is positioned between said first screen element and said light reject outlet.

19. The pressurized screen in accordance with claim 1, wherein said first screen element comprises a double conical form in which a diameter of said double conical form increases in said suspension flow direction.

20. The pressurized screen in accordance with claim 1, wherein a diameter of said conical shape increases in said suspension flow direction.

21. The pressurized screen in accordance with claim 1, wherein a diameter of said conical shape of said first screen element increases in a direction toward said second screen element.

22. The pressurized screen in accordance with claim 1, further comprising fixed screen scrapers located on a throughput side of said first screen element.

23. The pressurized screen in accordance with claim 1, further comprising fixed scrapers located on an inlet side of said first screen element.

24. The pressurized screen in accordance with claim 1, wherein an inlet side of said first screen element has a profiled surface.

25. The pressurized screen in accordance with claim 1, wherein an inlet side of said first screen element is equipped with bars.

26. The pressurized screen in accordance with claim 1, wherein said first screen element comprises round holes having a diameter of at least about 2 mm.

27. The pressurized screen in accordance with claim 26, wherein said at least some of said round holes have a diameter of at least about 4 mm.

28. The pressurized screen in accordance with claim 1, wherein said round holes have a diameter of at least about 4 mm.

29. The pressurized screen in accordance with claim 1, wherein said first screen element comprises screen openings having different sizes in accordance with a radial position on said first screen element.

30. The pressurized screen in accordance with claim 29, wherein said screen openings increase in size as the radial position of said screen opening is farther out.

31. The pressurized screen in accordance with claim 1, further comprising at least one flow guide element located in an intake chamber adjacent said first screen element.

32. The pressurized screen in accordance with claim 31, wherein said at least one flow guide element is arranged to influence peripheral movement of the suspension in said intake chamber.

33. The pressurized screen in accordance with claim 32, wherein said at least one flow guide element comprises arched surfaces arranged to divert a peripheral flow in said intake chamber radially toward a middle.

34. The pressurized screen in accordance with claim 1, wherein said second screen element comprises a cylindrical screen basket.

35. The pressurized screen in accordance with claim 1, wherein said second screen element comprises round screen openings having a diameter of no more than about 2 mm.

36. The pressurized screen in accordance with claim 1, further comprising a rotor and scrapers coupled to said rotor, whereby said scrapers are arranged for movement to keep said second screen element clear.

37. The pressurized screen in accordance with claim 36, wherein said rotor is coupled to rotatably drive said first screen element.

38. The pressurized screen in accordance with claim 36, wherein said rotor moves said scrapers at speed different than a rotational speed of said first screen element.

39. The pressurized screen in accordance with claim 36, further comprising a first and a second rotor;

said first rotor being coupled to said first screen element to rotatably drive said first screen element;

said second rotor being coupled to said scrapers to move said scrapers.

40. The pressurized screen in accordance with claim 39, wherein said rotors are coaxially arranged.

41. The pressurized screen in accordance with claim 1, wherein said at least one intake opens tangentially into said housing.

42. The pressurized screen in accordance with claim 1, wherein a largest inside diameter of said first screen element is larger than a largest inside diameter of said second screen element.

43. A process for removing contaminants from a contaminant-containing fibrous paper suspension, the process comprising:

supplying the suspension containing contaminants into a pressurized screen;

separating a coarse fraction of contaminants with a first rotating conical screen element, the first rotating conical screen having an opening angle ($\alpha$) of between about 10° and 170°;

separating a fine fraction of contaminants with a second screen element; and conveying the suspension without the coarse and fine contaminants out the pressurized screen.

44. The process in accordance with claim 43, wherein the coarse fraction separation occurs upstream of the fine fraction separation, relative to a suspension flow direction.

45. The process in accordance with claim 44, wherein the coarse fraction separation occurs vertically above the fine fraction separation.

46. The process in accordance with claim 44, wherein the coarse fraction separation occurs horizontally adjacent the fine fraction separation.

* * * * *